United States Patent [19]

Okcuoglu

[11] 4,264,220

[45] Apr. 28, 1981

[54] PRINTWHEEL HOMING APPARATUS

[75] Inventor: Selahattin A. Okcuoglu, Lexington, Ky.

[73] Assignee: International Business Machines Corporation, Armonk, N.Y.

[21] Appl. No.: 102,792

[22] Filed: Dec. 12, 1979

[51] Int. Cl.[3] ..... B41J 1/30

[52] U.S. Cl. ..... 400/144.2; 101/93.19

[58] Field of Search ..... 400/70, 144.2, 144.3, 400/322, 719; 101/93.19; 364/200 MS File, 900 MS File

[56] References Cited

U.S. PATENT DOCUMENTS

| | | | |
|---|---|---|---|
| 4,091,911 | 5/1978 | Chang et al. | 400/144.2 X |
| 4,198,169 | 4/1980 | Stuiber et al. | 400/144.2 |

*Primary Examiner*—Paul T. Sewell

*Attorney, Agent, or Firm*—John W. Girvin, Jr.

[57] ABSTRACT

In a printwheel type of printer using a selection stepper motor for driving the printwheel, means are provided for performing printwheel homing operation upon occurrence of predetermined events. Such an event, is detected and reported to microprocessor means which drive motion means for bringing the printer carriage assembly to a first extreme left position where a stop element fixed relative to the printwheel rotation is made to enter the path of another stop element attached to rotate with the printwheel. Subsequently, the selection stepper motor driving the printwheel is driven for a number of steps at least equal to one motor revolution to ensure reaching inhibition of the printwheel rotation by bringing the rotating stop element into contact with the relatively fixed stop element. The carriage is then moved back to the left margin writing position where the relatively fixed stop element is withdrawn from the path of the other stop element and the angular printwheel home position is noted and stored by the microprocessor means.

8 Claims, 8 Drawing Figures

PRINTWHEEL HOMING APPARATUS

BACKGROUND OF THE INVENTION

This invention relates to electromechanical impact printing devices of the type employing a rotary type-face-carrier. More particularly, this invention relates to a homing system for printing systems of the kind noted wherein the rotary type-face-carrier is rotated for character selection purposes.

Rotary printing systems are known in which the printhead comprises a rotary type-face-carrier, e.g., a printwheel, including a plurality of resilient pads or fingers bearing printing elements. The printhead is located on a carriage for translation from one print position to the next along a print line direction during printing operations. This operation is performed by translating the carriage from left to right and back, using a series of cables and pulleys driven by a D.C. motor controlled by electronic circuitry. As the carriage-head assembly is moved from a print position to the next along the print line direction, the type-face-carrier is rotated about its axis for character selection purposes. This operation rotates the printwheel until the pad bearing the character to be printed faces the desired print position and is aligned with the striking end of a printhammer also mounted on the carriage. Printing is then performed while the carriage is momentarily stopped by actuating the printhammer to impress the character borne by the pad against an inking ribbon and a print receiving medium. After the printhammer rebounds toward its original rest position, the printwheel is rotated so that the next proper character pad is aligned with the printhammer, while the carriage is translated to the next character print location where the next character is to be printed. This process continues until a complete line has been printed, after which the carriage is returned to the next line starting position, e.g., which could either be the left margin position or the end of the following line in case of bi-directional printing, and the print receiving medium is moved in preparation for the printing of the next line of characters.

Proper operation of such rotary printing systems depends on a number of factors among which the proper character selection is one of the most critical. In so called closed-loop systems, the rotary printwheel cooperates with position sensing devices enabling the system associated logic equipment to determine permanently which character faces the printhammer. For instance, the printwheel includes detection marks or indicia which can be detected by a printwheel home detector during printwheel rotation. In response to detection of the detection marks, a printwheel home signal is generated by the detector and transmitted to the logic circuitry which controls the operation of a motor used to rotate the printwheel. With some additional logic and/or printwheel angular position detection means, the system is kept permanently aware of the printwheel angular situation. Such detection systems are generally located on the translating carriage adding weight thereto.

All of the necessary bulky and expensive sensing equipment used in the closed-loop systems may be avoided provided a few additional logic and control means are added to the machine. In so called open-loop systems, no expensive sensing means is used to permanently track the printwheel angular position and report it to the system control unit. The system needs only to know which character was last printed and which one should be next, to determine through a table look up operation the required printwheel angular displacement to be performed.

Naturally, before printing first starts, i.e., when the power is turned on, and even from time to time during normal printing operation, when a predetermined event occurs, both closed and open loop systems need some kind of homing operation to put the printwheel into a home angular position, i.e., a reference position, known to the system. This operation is fairly simple when dealing with closed loop type of equipment. For instance, the printwheel may be commanded to rotate in a given direction up to a velocity corresponding to the movement of a predetermined number of character element spaces per time unit and then be continuously rotated in that same direction at this velocity until the printwheel home detector detects a home mark on the wheel a predetermined number of times. When this occurs, a signal is generated indicating home position to the system which will then track the wheel rotation through a control of the rotation driving means.

While the requirement for homing operation is obviously even more critical with open loop type of equipment where any error in homing operation would lead to a totally incorrect subsequent printing, no sensing equipment is normally available in such type of equipment, which could be used for homing purposes.

Some open loop printers have been equipped with optoelectronic or with electromagnetic type of sensors especially intended for homing purposes. These devices and their read out electronics are relatively expensive.

SUMMARY OF THE INVENTION

An object of the invention is to provide simple and inexpensive but yet reliable homing means for printing systems using type-face-carriers which are positioned into printing position through, at least, rotation about one given axis.

According to the present invention, inexpensive means are provided for performing homing of a rotary type-face-carrier to be used with equipment in which the positioning of a character to be printed, with respect to printing position, is performed through linear displacement of a carriage supporting a printhead and rotation of the type-face-carrier attached to said printhead about at least one given direction. Initial type-face-carrier homing operation is performed when specific situations occur such as detection of printer power-on setting, by automatically shifting the carriage within the printer housing limits, in a direction parallel to the record medium holder, i.e., platen, down to a given extreme position where a stop element fixed relative to the rotation of the type-face-carrier about the at least one given direction, is made to extend within the path of another stop element attached to rotate with the type-face-carrier. The type-face-carrier rotation means are then excited to rotate the type-face-carrier a sufficient angle to ensure mechanical engagement of one stop element in contact with the other, which stops the type-face-carrier and inhibits it from further rotating. Then the carriage is automatically moved to a given position where the relatively fixed stop element is made to clear the path of the other stop element.

A fuller understanding of the nature and advantages of the invention will derive from the following detailed description in conjunction with the accompanying drawings.

DETAILED DESCRIPTION OF THE INVENTION

Figure 1:
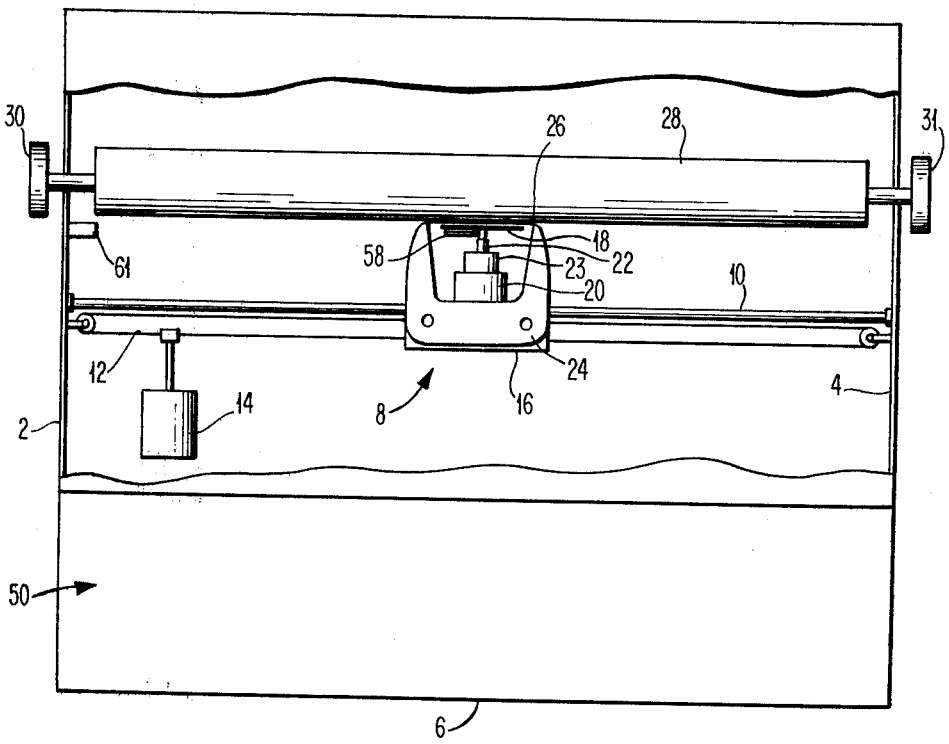
FIG. 1 is a top plane view of a rotary type of printer embodying the invention.

FIG. 1 shows a top plane view of a rotary type of printer embodying the invention. The printer has left and right side plates 2 and 4, and a base 6, for housing the mechanical components, most of the electrical components and some of the electronic and logic parts of the machine. The rest of the circuits will be located in a separate housing not shown.

A carriage assembly 8 is slidingly supported by a shaft 10, and can be shifted between said left and right side plates 2 and 4 by a belt and pulley assembly 12 driven by a carriage stepper motor 14. Carriage assembly 8 includes a base plate 16 which provides support for the rotatable type-face-carrier, e.g., printwheel 18, for a type-face-carrier rotation means, i.e., the selection stepper motor 20 which rotates the printwheel 18, for the hammer 22 and driver 23 assembly, and for a ribbon cartridge 24 interposing an inking ribbon 26 between printwheel 18 and record medium holder or platen 28. The platen 28 is rotatably secured to the side plates 2 and 4 to support the record medium (not shown). The platen 28 is provided with conventional platen knobs 30 and 31 and with automatic motion means (not shown) which enable rotating the platen to transfer the record or print receiving medium from one printing line position to another.

The printer is also provided with a printwheel homing device including a first (58) and a second (61) stop elements which will be described further on.

In operation, feeding the carriage motion means, i.e., carriage stepper motor, 14 with signals provided by electronic and logic control circuitry (see FIG. 2) causes the belt and pulley assembly 12 to move the carriage assembly 8 from left to right or vice-versa along a print line direction and from one print position to the next. While shifting the carriage assembly 8, the printwheel 18 is also rotated about its axis by the selection stepper motor 20 for character selection purposes in order to present the pad bearing the character to be printed in front of a printing position on the record medium, and within the path of hammer 22. With the selected pad positioned, driving the driver 23 will make the hammer 22 strike the printing character against the inking ribbon 26 and print receiving medium and print the selected character.

The two stepper motors 14 and 20 (see FIG. 2) are driven by motor driver circuits 32 and 34 controlled by logic circuitry composed of one master microprocessor 36, two separate slave microprocessors 38 and 40 provided with associated external memories 42 and 44 and output ports 46 and 48 respectively. These slave microprocessors 38 and 40 are respectively intended for driving the carriage stepper motor 14 and the selection stepper motor 20. Other slave microprocessors (not shown) are used for performing other printer functions not involved in homing operations.

The depressing of any character key (not shown) on the printer board 50 shown in FIG. 1 is detected and reported to the master microprocessor 36 as a command. The master microprocessor 36 identifies the command, defines the functions to be performed and distributes the jobs to the slave microprocessors. The master microprocessor 36 is also kept aware of the evolution of the functions under performance by the slaves in order to synchronize these functions with each other. The slave microprocessors used to control stepper motor operations have to provide sequences of coded signals based on both the type of move to be performed by the stepper motor involved and the type of stepper motor used. The step-phase relationship of each stepper motor is defined through a phase table T1 (not shown) comprising a set of binary words permanently stored into the internal memory of the associated slave microprocessor 38 or 40, while the corresponding external memory 42 or 44 stores profiles. A profile consists of a sequence of phase and time data selected by the designer for performing a specific and complete move or sequence of stepper motor steps with the best possible efficiency and reliability. Knowing the actual position of a stepper motor and the desired next position, the slave microprocessor controlling that stepper motor feeds the corresponding motor driver circuit with a sequence of data derived from a profile, which data are then converted by said motor driver circuit into sets or trains of time varying current pulses fed into the motor phase circuits in accordance with the indications of the phase table of the motor involved. The motor acceleration and speed rates depend on the shapes of the current pulse trains applied to selected motor phases. The motor direction of rotation depends on the order in which the different phases are switched on and off.

In normal printing operation the depressing of a character key on the printer board is reported to the master microprocessor 36 through its status and data input as a command issued from a command source. Prior to any effective impact printing operation, the carriage assembly has to be moved along the print line to face the correct print position. This job is devoted to the slave microprocessor 38. In addition, the printwheel 18 has to be rotated to present the adequate pad to face the hammer 22. This function is devoted to the slave microprocessor 40. Both operations are initiated and synchronized by the master microprocessor 36. For instance, the selected character to be printed is identified by the master microprocessor 36 and this identity is reported to the slave microprocessor 40 which stores it into one of its internal registers (R2) while the identity of the last character printed has been transferred from register R2 into a register R1. Also stored in the slave microprocessor 40 internal memory is a table T2 (not shown) identifying the sequence of character distribution about the printwheel 18 periphery. Proper angular rotation of the printwheel 18 for character selection purposes involves the following operations to be controlled by the slave microprocessor 40. First the table T2 is consulted in order to determine the angular rotation to be performed by the printwheel 18 to move from the position identified by the contents of register R1 to the position identified by the contents of register R2. Then, based on this information, the profile in external memory 44 is addressed. This provides a selected microprogram to be read into the slave microprocessor 40, which then addresses the table T1. The phase-table data is in turn used to control the stepper motor driver circuit 34 through the output ports 48.

The contents of R2 is shifted into R1 setting the system ready for a new character selection operation.

With similar means and in a similar manner, the slave microprocessor 38 together with its external memory 42, the output ports 46 and the motor driver circuit 32 will drive the carriage stepper motor 14 to bring the carriage assembly 8 to the adequate position along the printing line.

Due to the dependency of the angular printwheel movement upon the contents of R1, any error in said R1 contents would tend to propagate to subsequent printing. A correct setting of this register is thus particularly important. In addition, when the power is turned off the registers R1 and R2 are reset to zero. Therefore, upon power-on, a homing function must be performed, i.e., the printwheel 18 should be first set to a position known to the slave microprocessor 40 (i.e., loaded into its register R1) and qualified as printwheel home position. In closed loop type systems, sensing devices are available, which, with some additional electronics and logic, could help in performing the homing function. In open loop type systems, the homing function can be performed with a good price-efficiency relationship, using the stop elements of this invention in conjunction with the logic of FIG. 2 and control logic.

Figure 3A:
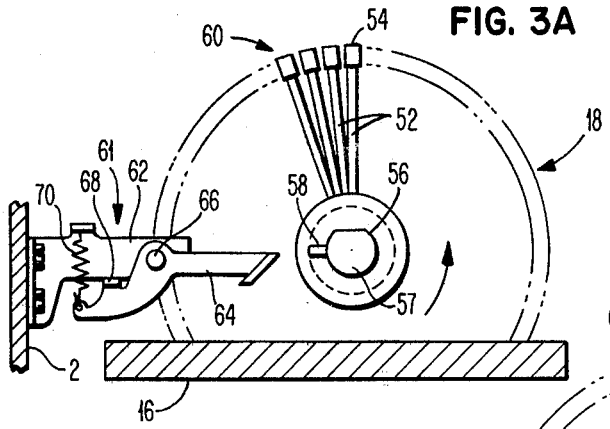
FIGS. 3A and 3B show one embodiment of the stop elements of the invention.
Figure 3B:
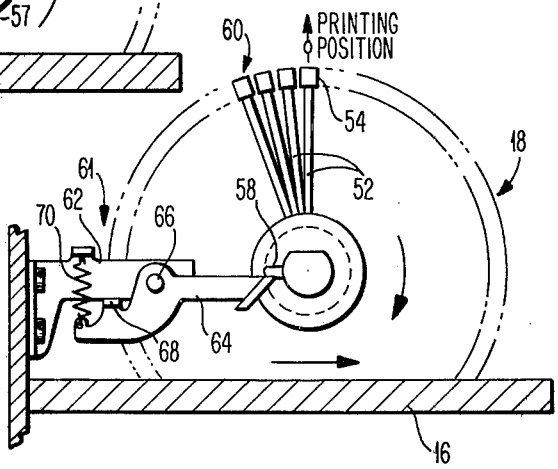

FIGS. 3A and 3B show one embodiment of the stop elements of the invention. A printwheel 18 comprising resilient pads 52 which support print characters 54 on their extremities is shown. The printwheel including a hub 56 is adapted to be made to rotate with the motor shaft 57 by the selection stepper motor 20 (FIG. 1), to bring any selected pad into a predetermined printing position located on the hammer 22 (FIG. 1) path. The printwheel hub 56 is provided with a first stop element or knob 58, which can be a 0.060 inch molded member fixed at any desired fixed angle from the printwheel home pad position. This knob 58 is attached to rotate with the printwheel 18. The home pad 60 has been selected to be the third pad to the left of the pad set into printing position when the printwheel 18 is stopped, as shown on FIG. 3B. But no matter what the printwheel home pad angular position is, the homing operation should identify and bring the home pad 60 with the printing position.

A second stop element 61 is attached to the left side plate 2 of the printer housing. This second stop element 61 comprises essentially a bracket 62, carrying a latch 64. The bracket 62 is vertically adjustable while the latch 64 is adjustable. The latch 64 can rotate about an axis or pivot 66 parallel to the rotation axis of the printwheel 18. Under normal printing conditions, the farthest left position to be reached by the carriage assembly 8 of FIG. 1, i.e., the left printing margin position is such that, while the printwheel 18 rotates for character selection purposes, the knob 58 scans a path normally out of the space limits into which the latch 64 (see FIG. 3A) extends. This second stop element is shown on FIG. 3A in a rest position with a limiting member 68 forbidding the latch 64 to rotate clockwise any further under the impetus of a return spring 70.

Figure 2:
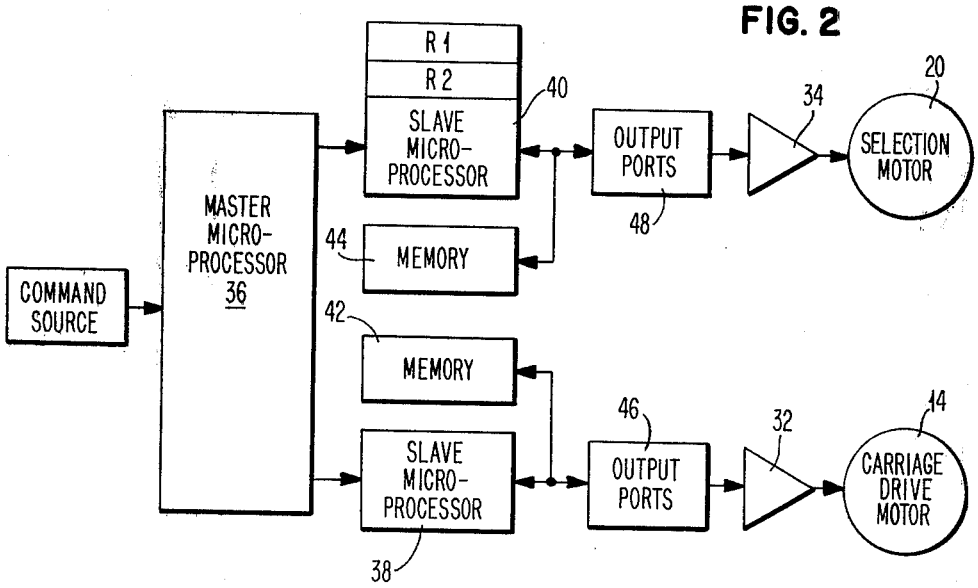
FIG. 2 is a block diagram of the logic controlling the printer motors of the invention.

Upon power-on detection, the logic control on FIG. 2, i.e., master-slave arrangement 36–38 and driver circuit 32 drives the carriage stepper motor 14 to bring the carriage assembly 8 to an extreme left position where the side plate 2 prevents the carriage assembly 8 from moving any further left by having the base plate 16 abutting against said side plate 2. There, the latch 64 engages into the rotary path limits which would be scanned by the knob 58 while the printwheel 18 would rotate (see dashed lines on FIGS. 3A and 3B).

The printwheel selection stepper motor 20 may be detented or not during this time. When the carriage assembly 8 is made to reach that first extreme left position, the knob 58 is at random orientation. If the printwheel 18 rotates in clockwise direction, then the knob 58 might hit the latch 64 below the position shown on FIG. 3B. Then due to its chamfer shaped end, the latch 64 rotates about its pivot 66 in counterclockwise direction away from limiting member 68, to enable moving the carriage assembly 8 further to the desired extreme left position. Now, when the carriage assembly 8 is at that position, the slave microprocessor 40 drives the selection stepper motor 20 with a fixed set of instructions such that said selection motor 20 would normally be stepped more than one revolution in counterclockwise direction. This assures that the printwheel 18 will be rotated enough for the knob 58 to reach the latch 64 which has returned against the limiting member 68 under the impetus of the return spring 70 as in FIGS. 3A and 3B. The selection stepper motor 20 might be still electrically driven until the end of the fixed set of instructions while it is mechanically non-rotating without this being detrimental to the motor. After the last instruction is executed, the printwheel 18 is made to rotate clockwise for a predetermined number of steps depending upon the angular position of the home pad 60 with respect to printing position in order to bring said home pad into printing position. This number of steps has been selected to be three with the arrangement of FIGS. 3A and 3B. Then the carriage assembly 8 is made to move to the left margin writing position (see FIG. 3A) where the latch 64 clears the path of knob 58. At completion of homing operation, the contents of the table T2 at the address corresponding to the home pad, is loaded and stored into register R1 acting as storage means for identifying the present angular position of the printwheel 18.

Figure 4A:
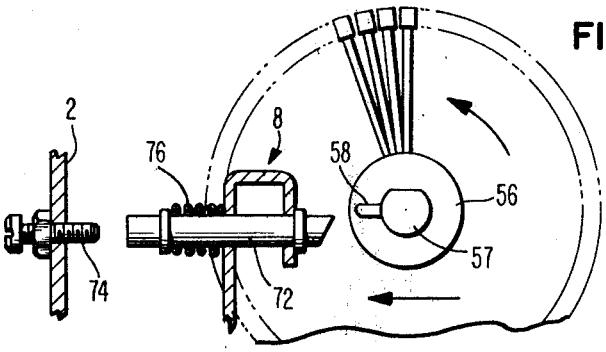
FIGS. 4A and 4B show another embodiment of the stop elements of the invention.
Figure 4B:
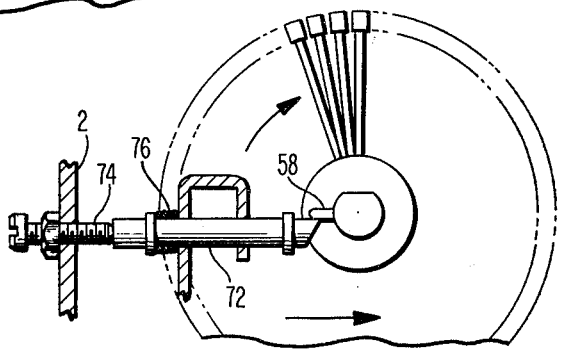

FIGS. 4A and 4B show a simplar arrangement for the second stop element. An interposer 72 is now mounted on the carriage assembly 8 and an adjustable screw 74 is inserted into the left side plate 2. The interposer 72 is made to be slidable or reciprocable in a plane parallel to the path of first stop element 58 and is maintained out of said path under the impetus of a spring 76 except when the carriage is shifted to the left against the adjustable screw 74. FIG. 4A shows the second stop element with interposer 72 positioned out of the path of the knob 58 by the spring 76 being relaxed, while FIG. 4B shows the same second stop element with the spring 76 compressed whereby the interposer 72 is made to extend within the path of knob 58.

As mentioned before, homing operations are needed when the printer power is set on. But such a need may also occur while the printer is operating. With reference to FIG. 2, the need for performing the homing operations will be decoded by the master microprocessor 36 detecting the occurrence of a predetermined event, e.g., the setting on of the printer electric power or the detection of a specific instruction. Upon detection of such an event, the master microprocessor 36 controls the logic flow between the two slave microprocessors 38 and 40, as shown on the timing diagram of FIG. 5.

Figure 5:
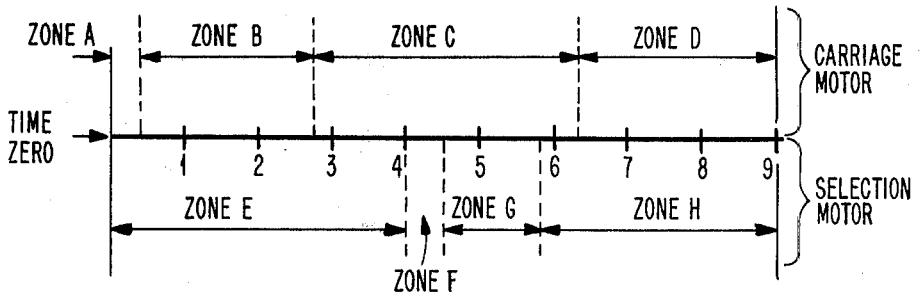
FIG. 5 shows a timing diagram to be used to perform the homing function.

FIG. 5 shows a timing diagram for performing the printwheel 18 homing function using a 3-phase ninety six steps variable reluctance stepper motor as selection motor 20, and a 6-phase four hundred and twenty steps variable reluctance stepper motor as carriage motor 14. Starting at time zero zones A through D show the timing schedule for the carriage motor 14, while zones E through H show the timing schedule for the selection motor 20 for the same period of time.

For the Carriage Stepper Motor 14:

Zone A: Accelerate the carriage assembly 8 to 5.81 inches/sec.

Zone B: Move the carriage assembly 8 to the left at 5.81 inches/sec. for 3188 motor steps, i.e., 13.2 inches.

Zone C: Move the carriage assembly 8 to the left for 180 steps at 20 milliseconds per step. (This is to ensure that the carriage assembly 8 reaches the extreme left position, to offset any bounce-away that may occur and to keep the carriage assembly 8 at the left stop).

Zone D: Wait 650 milliseconds and then move the carriage assembly 8 to the right down to the left writing margin position, for 72 steps (This move assures that the knob 58 clears the relatively fixed second stop member so the printwheel 18 can rotate in either direction freely).

For The Selection Motor 20:

Zone E: Initialize the selection motor 20 to reach a normal speed in counterclockwise direction and then wait up to 4 seconds (delay to ensure that the carriage assembly 8 has reached the extreme left position regardless of where it was at the time of power-on).

Zone F: Run the selection motor 20 for 48 steps in counterclockwise direction and wait 50 milliseconds.

Zone G: Run the selection motor 20 in counterclockwise direction for 48 steps with 20 milliseconds delay after each step, then wait for 50 milliseconds.

Zone H: Rotate the printwheel 18 3 steps in clockwise direction to the home position, then wait 20 milliseconds.

NOTES: (1) Whenever one of the stepper motors 14 and 20 reaches a stop position, it could still be driven for a short period of time without being deteriorated. This enables performing the functions defined in the above mentioned zones, using predetermined microprograms stored in the microprocessor memories without any consideration of the actual location of the carriage assembly 8 and printwheel 18 at power-on.

(2) The last printwheel step (Zone H) is only due to the fact that the home pad 60 has been selected to be three steps away from printing position when the first and second stop elements are made to come into contact with each other. However, the home pad 60 could be selected at any known angular position from the first stop element 58.

(3) The stepper motors 14 and 20 cannot reach a given speed instantaneously. They should, first, be brought to that speed at a selected acceleration rate.

The above functions are performed by having stored microprograms run the microprocessors to control the motor driver circuits 32 and 34 to feed the necessary time varying current signals into the motor coil phases.

Figure 6:
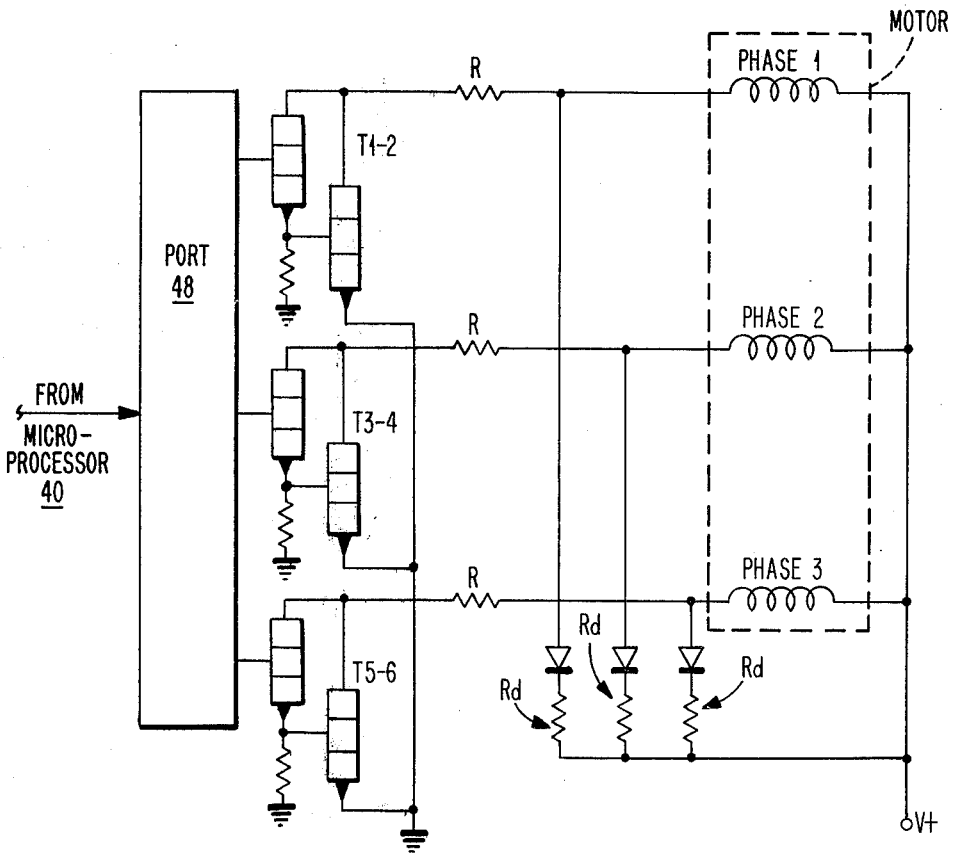
FIG. 6 represents a motor driver circuit arrangement for a three phase stepper motor.

FIG. 6 shows a motor driver circuit arrangement for a three phase stepper motor. The motor driver circuit is made of three double transistor current amplifiers T1-2, T3-4 and T5-6 driving the different motor phases. A resistor R is used on each motor phase to decrease the motor coil time constant, while a series diode-resistor arrangement Rd is used on each motor phase to provide a return current path to the motor phase coil just turned off.

The microprocessors used may be conventional commercially available microprocessors such as Intel 8085 for the master function and Intel 8041 for the slave functions.

Attached are a set of programs used for performing the homing function using the above mentioned Intel Systems. The main part of the attachment consists of two programs, one for the "SELECTION MOTOR" 20, the other for the "CARRIAGE MOTOR" 14. These programs call for subroutines such as SYGETPHS for initialization purposes; SYDELAY for counting delays; or SYSLEXPR. SYGETPHS and SYDELAY subroutines (not shown) are conventional initializing and counting routines. The "CARRIAGE MOTOR" program also requires two profiles designated by "Home Profile" and "Short Tab Profile" respectively.

It is recognized that the carriage assembly 8 could be driven to the right side frame extreme position to effect the homing operation although the left side frame extreme position is preferred due to its proximity to the normal print starting point.

While the invention has been particularly shown and described with reference to the preferred embodiments thereof, it will be understood by those skilled in the art that the foregoing and other changes in form and details may be made therein without departing from the spirit and scope of the invention.

SELECTION MOTOR

```
                                  1. SET PHASE TABLE POINTER TO TOP OF PHASE
                                     TABLE;
SYSLHOME MOV R7, SZINITPT-X'0100'
CALL SYGETPHS                     (TO INITIALIZE)
OUTL P1,A
                                  1. DELAY FOR CARRIER TO REACH ABSOLUTE
                                     LEFT MARGIN (4 SEC.);
MOV R4,X'C8'
SYZSHCDL MOV A,X'06'
CALL SYDELAY                      (TO COUNT 4 SEC)
DJNZ R4,SYZSHCOL
                                  1. LOAD COMPARE TIME REGISTER FOR MOVE 48;
MOV R3,SZCTLONG
                                  1. SET CONTROL WORD POINTER TO MOVE 48;
MOV R0,SZMVLONG
```

-continued

| SELECTION MOTOR | |
|---|---|
| MOV R6,X'25' | 1. SET VARIABLE RUNS REGISTER FOR MOVE 48; |
| CALL SYSLEXPR | 1. EXECUTE 48-STEP MOVE; |
| MOV R4,X'05'<br>SYZSHSDL MOV A,131<br>CALL SYDELAY<br>DJNZ R4,SYZSHSDL | 1. POST-MOVE DELAY (50 MSEC);<br><br>(TO COUNT 50 MSEC) |
| SEL RB1<br>MOV R4,48 | 1. SET MOVE COUNTER TO 48; |
| SYZSHONE SEL RBO | 1. REPEAT |
| MOV R3,SZCT1 | 2. . LOAD COMPARE TIME REGISTER FOR MOVE 1; |
| MOV R0,SZMV1 | 2. . SET CONTROL WORD POINTER TO MOVE 1; |
| MOV A,R5<br>ANL A,SZCLRPAG<br>MOV R5,A | 2. . CLR PAGE FLAG; |
| CALL SYSLEXPR | 2. . EXECUTE 1-STEP MOVE; |
| MOV A,X'06'<br>CALL SYDELAY | 2. . POST-MOVE DELAY (20 MSEC);<br>(TO COUNT 20 MSEC) |
| SEL RB1 | 2. . DECREMENT MOVE COUNTER; |
| DJNZ R4,SYZSHONE | 1. UNTIL MOVE COUNTER = 0 |
| SEL RB0 | 1. ENDREPEAT; |
| MOV R4,X'05'<br>SYZSHEDL MOV A,131<br>CALL SYDELAY<br>DJNZ R4,SYZSHEDL | 1. POST-MOVE DELAY (50 MSEC);<br><br>(TO COUNT 50 MSEC) |
| MOV R3,SZCT3 | 1. LOAD COMPARE TIME REGISTER FOR MOVE 3; |
| MOV A,R5<br>ANL A,SZCLBDP<br>MOV R5,A | 1. SET CONTROL WORD POINTER TO MOVE 3;<br>1. SET DIRECTION TO PLUS & CLR PAGE FLAG; |
| CALL SYSLEXPR | 1. EXECUTE 3-STEP MOVE; |
| MOV A,X'06'<br>CALL SYDELAY | 1. POST-MOVE DELAY (20 MSEC);<br>(TO COUNT 20 MSEC) |
| | 1. EXIT TO DECODE ROUTINE;<br>ENDSEGMENT (SYSLHOME); |

| CARRIAGE MOTOR | |
|---|---|
| SYCHROME EQU* | |
| CALL SYPTINIT | 1. INITIALIZE PHASE TABLE; |
| MOV R5,X'E9' | 1. INITIALIZE FLAGS (DIR, EOP*, LS*, EOR* SET & NOW, CW2, VAR RESET); |
| MOV R6,SZLTAB-1 | 1. SET CONTROL WORD POINTER TO HOME PROFILE. |
| MOV R4,SZFLSTPS | 1. LOAD RUN COUNTER WITH FIRST LEVEL STEPS; |
| MOV R1,SZTHOLD<br>MOV @R1,SZFLTIME | 1. LOAD SZTHOLD WITH FIRST LEVEL TIME; |
| CALL SYNEWPHS | 1. GET FIRST PHASE & STORE IN SZPHOLD; |
| SYZCHACC EQU* | 1. REPEAT |
| CALL SYSTEP | 2. . CALL (SYSTEP) OUTPUT PHASE, LOAD & START TIMER; |
| CALL SYNXTMOV | 2. . CALL (SYNXTMOV) DETERMINE NEXT PHASE & TIME; |

-continued

| CARRIAGE MOTOR | |
|---|---|
| | 2. . WAIT FOR TIMER TO EXPIRE; |
| SYZCHWTA JTF SYZCHSTA | |
| JMP SYZCHWTA | |
| | 2. . STOP TIMER/COUNTER; |
| SYZCHSTA STOP TCNT | |
| | 1. UNTIL END OF PROFILE FLAG ACTIVE |
| MOV A,R5 | |
| JB6 SYZCHACC | |
| | 1. ENDREPEAT; |
| | 1. SET RUN COUNTER TO 180 STEPS |
| MOV R4,X'B4' | |
| | 1. REPEAT |
| SYZCHSLW EQU* | |
| | 2. . GET NEXT PHASE FROM SZPHOLD & OUTPUT TO MOTOR; |
| MOV R1,SZPHOLD | |
| MOV A,@R1 | |
| OUTL P1,A | |
| | 2. . DECREMENT RUN COUNTER; |
| DJNZ R4,SYZCHMVL | |
| JMP SYZCHMVR | |
| | 2. . CALL (SYNEWPHS) DETERMINE NEXT PHASE; |
| SYZCHMVL CALL SYNEWPHS | |
| | 2. . DELAY 20 MSEC; |
| MOV R3,X'01' | |
| CALL SYLNGDLY | |
| | 1. UNTIL RUN COUNTER = ZERO |
| JMP SYZCHSLW | |
| | 1. ENDREPEAT; |
| SYZCHMVR EQU * | |
| | 1. DELAY 100 MSEC; |
| MOV R3,X'05' | |
| CALL SYLNGDLY | |
| | 1. SET CWP TO SHORT TAB (3 IPS OTF) PROFILE; |
| MOV R6,SZ3IPS | |
| | 1. SET EOP*, LS*, NOW, VAR, & EOR* FLAGS, AND CLEAR DIR & CW2 FLAGS; |
| MOV 45,X'73' | |
| | 1. LOAD VARIABLE RUNS REGISTER WITH #RUNS FOR 72 STEP MOVE; |
| MOV R3,X'32' | |
| | 1. CALL (SYSLEXPR) EXECUTE +72 STEP MOVE; |
| CALL SYSLEXPR | |
| | 1. EXIT PROCESS ROUTINE; ENDSEGMENT (SYCHROME); |

| SYSLEXPR | |
|---|---|
| | 1. CALL (SYNXTMOV) DETERMINE PHASE AND DELAY AT FIRST STOP |
| CALL SYNXTMOV | |
| | 1. REPEAT |
| | 2. . CALL (SYSTEP) SEND NEW PHASE TO MOTOR LOAD & START TIMER |
| SYZMXSTP CALL SYSTEP | |
| | 2. . CALL (SYNXTMOV) DETERMINE PHASE & DELAY OF NEXT STEP; |
| CALL SYNXTMOV | |
| | 2. . WAIT FOR TIMER TO EXPIRE; |
| SYZMXWAI JTF SYZMXTST | |
| JMP SYZMXWAI | |
| | 2. . STOP TIMER/COUNTER; |
| SYZMXTST STOP TCNT | |
| | 1. UNTIL END OF PROFILE FLAG IS ACTIVE |
| MOV A,R5 | |
| JB6 SYZMXSTP | |
| | 1. ENDREPEAT; |
| | 1. RETURN TO CALLING ROUTINE; |
| SYZMXRET RET | |
| | ENDSEGMENT (SYSLEXPR); |

HOME PROFILE

| #STEPS: | DELAY (μs): |
|---|---|
| 7 | 2000 |
| 14 | 1037 |
| 3188 | 717 |

-continued

| SHORT TAB PROFILE | |
|---|---|
| #STEPS: | DELAY (μs) |
| 14 | 1990 |
| 51 | 1389 |
| 7 | 4600 |

What is claimed is:

1. A type-face-carrier homing apparatus for an electronic impact printer comprising:

a housing provided with side plates;

a record medium holder positioned within said housing between said side plates;

a carriage assembly slidingly supported to move in parallel direction to said record medium holder;

carriage assembly motion means for moving said carriage assembly;

a rotatable type-face-carrier bearing printing types, said type-face-carrier being attached to move with said carriage assembly;

type-face-carrier rotation means for rotating the type-face-carrier for character selection purposes;

a first stop element attached to rotate with said rotatable type-face-carrier;

a second stop element fixed relative to the rotation of said rotatable type-face-carrier;

means responsive to the detection of a predetermined event for driving said carriage assembly motion means to bring said carriage assembly into a first given extreme position where said second stop element is made to extend within the path of said first stop element when said type-face-carrier rotates;

means for driving said type-face-carrier rotation means to rotate said type-face-carrier and bring said first stop element into contact with said second stop element so as to prevent said type-face-carrier from rotating any further;

means for subsequently driving said carriage assembly motion means to bring said carriage assembly into a second given position where said second stop element is made to extend out of the path of said first stop element;

storage means; and, loading means for loading the information characterizing the angular position of the home pad of said rotatable type-face-carrier as stopped, into said storage means.

2. A type-face-carrier homing apparatus according to claim 1, wherein said first stop element is a knob attached to the type-face-carrier to scan a circular path concentric with said type-face-carrier, during rotation of said type-face-carrier.

3. A type-face-carrier homing apparatus according to claim 2, wherein said second stop element is attached to a side plate of the printer housing.

4. A type-face-carrier homing apparatus according to claim 3 wherein said second stop elements includes:

a bracket element;

means for rigidly connecting said bracket element to one side plate of the printer housing;

a chamferred latch element;

pivot means for pivotally connecting said latch element to said bracket element in a plane parallel to the path of said first stop element;

limiting member means for limiting the movement of said latch about said pivot, in one direction; and, return spring means connected for bringing said latch back to its rest position whenever it is pivoted away from said rest position.

5. A type-face-carrier homing apparatus according to claims 1, 2, 3 or 4 wherein said type-face-carrier is a printwheel.

6. A printwheel homing apparatus for an electronic impact printer including:

a housing provided with side plates;

a platen positioned within said housing between said side plates;

a carriage assembly reciprocatable along said platen within said housing;

a carriage assembly motion means for moving said carriage assembly along said platen;

a printwheel attached to move with the carriage and provided with a home pad;

a stepper motor means for rotating the printwheel for character selection purposes;

a first stop element attached to rotate with the printwheel and placed at a fixed angle with respect to said home pad;

a second stop element fixed relative to said printwheel;

processor means responsive to the detection of a predetermined event, for driving said carriage assembly motion means to bring said carriage assembly into a first given extreme position where said second stop element is made to extend within the path of said first stop element when said printwheel is made to rotate;

processor means for subsequently driving said stepper motor means for a number of steps sufficient for driving said stepper motor for at least one full revolution, therefore ensuring that said first stop element will come into contact with said second stop element and stop said printwheel from rotating;

means for driving said stepper motor means for a predetermined number of steps for bringing said home pad into printing position;

storage means; and, loading means for loading the information relating to the identity of the character borne by said home pad into said storage means.

7. A printwheel homing apparatus for an electronic impact printer according to claim 6, wherein said carriage assembly motion means includes a stepper motor.

8. A printwheel homing apparatus according to claim 6 or claim 7 wherein said second stop element is attached to the printer housing.

* * * * *